US006414257B1

(12) United States Patent
Luscan et al.

(10) Patent No.: US 6,414,257 B1
(45) Date of Patent: Jul. 2, 2002

(54) GAS-INSULATED CIRCUIT-BREAKER WITH AN INTEGRATED ELECTRONIC CURRENT TRANSFORMER

(75) Inventors: Bruno Luscan, Lyons; Alain Libaud, Saint Etienne des Oullieres; Olivier Grejon, Sathonay Camp, all of (FR)

(73) Assignee: Alstom, Paris (FR)

( * ) Notice: Subject to any disclaimer, the term of this patent is extended or adjusted under 35 U.S.C. 154(b) by 0 days.

(21) Appl. No.: 09/951,390

(22) Filed: Sep. 14, 2001

(30) Foreign Application Priority Data

Sep. 20, 2000 (FR) ..... 00 11966

(51) Int. Cl.[7] ..... H01H 33/66
(52) U.S. Cl. ..... 218/118; 218/141; 218/142
(58) Field of Search ..... 218/70–72, 78, 218/80, 118, 92–97, 155, 43, 87, 131, 122, 129, 138, 44, 45, 68, 69, 100, 101, 123, 91; 335/195, 19, 154, 141–142

(56) References Cited

U.S. PATENT DOCUMENTS 3,114,815 A 12/1963 Easley et al.
4,117,288 A * 9/1978 Gorman et al. ..... 218/129
4,272,661 A * 6/1981 Dethlefsen ..... 218/142
4,742,197 A * 5/1988 Mauthe ..... 218/68

FOREIGN PATENT DOCUMENTS

| | | |
|---|---|---|
| DE | 196 08 285 A | 8/1997 |
| EP | 0 446 837 A | 9/1991 |
| FR | 2 525 807 A | 10/1983 |
| GB | 782 264 A | 9/1957 |

* cited by examiner

*Primary Examiner*—Lincoln Donovan
*Assistant Examiner*—M. Fishman

(57) ABSTRACT

The single-phase circuit-breaker comprises at least one interrupting chamber formed by an insulating tube filled with an insulation gas, and it comprises at least one current transformer whose secondary is disposed in air around the primary at one end of the tube. The primary is at the high voltage electrical potential of the phase and is constituted by an annular metal support. The secondary is subjected to a high voltage electrical potential that is practically equal to the potential of the primary. The current transformer is thus integrated in the circuit-breaker, and the measurement electronics associated with the secondary can be located in air close to the secondary.

11 Claims, 3 Drawing Sheets

FIG_3
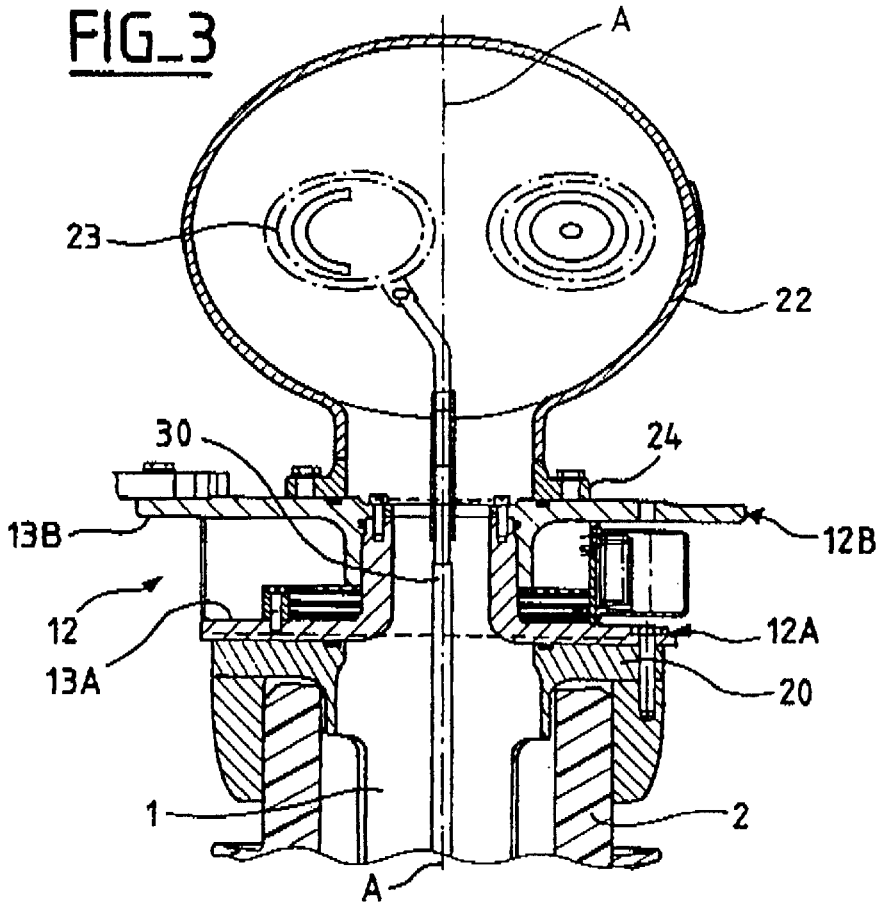
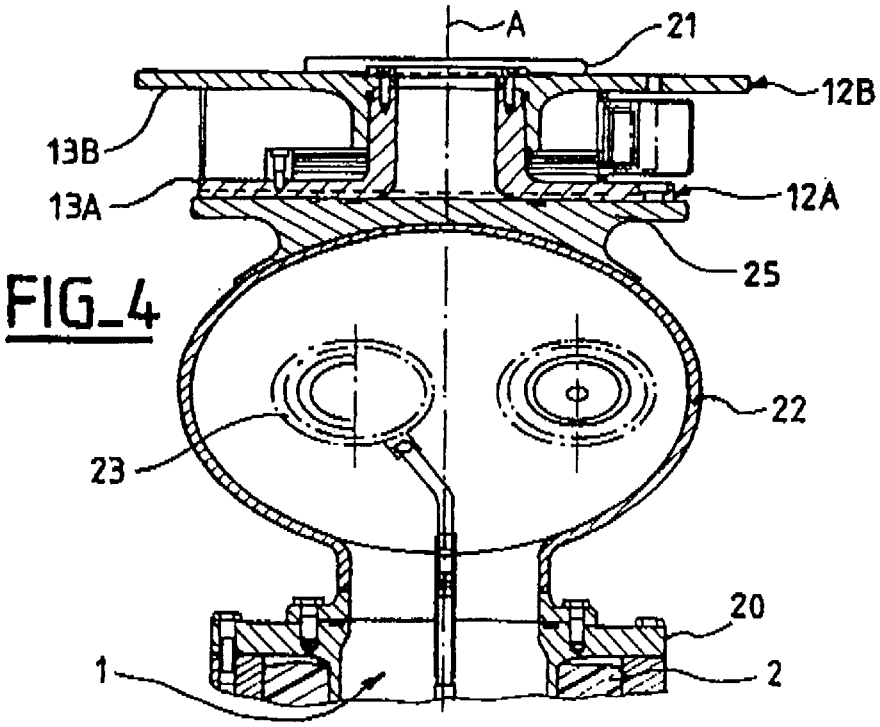
FIG_4

GAS-INSULATED CIRCUIT-BREAKER WITH AN INTEGRATED ELECTRONIC CURRENT TRANSFORMER

The invention relates to a single-phase high voltage circuit-breaker comprising at least one interrupting chamber formed by an insulating tube filled with an insulation gas, and having, for at least one interrupting chamber, a current transformer which comprises a primary and a secondary. The secondary is disposed in air around the primary at one end of the tube, and the primary is at the high voltage electrical potential of the phase.

BACKGROUND OF THE INVENTION

Patent document FR 2 525 807 discloses a high voltage circuit-breaker of that kind, in which the primary is constituted by a tubular conductor immersed in the insulation gas of the interrupting chamber. In an embodiment shown in FIG. 3 of that document, the secondary is based on a metal sleeve which surrounds the primary at one end of the insulating tube of the interrupting chamber. The sleeve is secured to a metal casing connected to ground potential and thus constitutes an electrostatic screen which enables the secondary to be at an electrical potential that is practically equal to ground potential. The current transformer implemented is of the "conventional" type in that the winding wires of its secondary are practically at ground potential. Such a conventional current transformer suffers in particular from the drawback of requiring the winding wires of the secondary to be taken to measurement devices that are connected to ground, and this is generally performed by means of a metal tube protecting the wires and connecting the electrostatic screen to ground potential. This means in particular that a certain amount of ground area in the vicinity of the high voltage circuit-breaker is occupied.

Patent document DE 1 960 828.5 discloses a gas-insulated circuit-breaker with one or more current transformers of the "incorporated electronic" type, in which the secondary of the transformer is located in the insulation gas of the interrupting chamber at one end of the insulating tube that forms said chamber. Such a disposition has the advantage of being compact in terms of ground area occupancy, but suffers from the drawback of requiring transformer maintenance that can be expensive because of the difficulty in accessing the secondary of the transformer and the need under such circumstances to empty the insulation gas out from the circuit-breaker.

OBJECTS AND SUMMARY OF THE INVENTION

An object of the invention is to propose a circuit-breaker of the first kind as defined above that enables maintenance costs of the current transformer to be reduced and also reduces the ground area occupied by the circuit-breaker. Another object is to provide a current transformer arranged in modular manner so as to make to possible for the transformer to be mounted in a plurality of different configurations independently of the configuration of the circuit-breaker (column circuit-breaker or T-configuration).

To this end, the invention provides a circuit-breaker of the above-defined kind, wherein the primary is constituted by a metal annular support and wherein the secondary is subjected to a high voltage electrical potential that is practically equal to the potential of the primary.

The primary of the transformer is thus an annular electrical conductor surrounded by air, and the secondary surrounds the primary directly without any interposed electrostatic screen and without an element of the secondary being connected to ground potential.

The secondary can thus be associated with an optical or an optoelectronic circuit placed close thereto in air and subjected to the high voltage electrical potential, such a circuit being connectable to devices disposed on the ground by means of optical fibers. Transformer maintenance, e.g. changing optoelectronic circuit cards, is made easier because the secondary is disposed in air.

In addition to its electricity-conducting function, the primary of the transformer also performs a mechanical support function when it is disposed at the interface between the interrupting chamber of the circuit-breaker and a support column, or at the interface between the interrupting chamber of the circuit-breaker and a closure resistor casing, or else at the interface between the interrupting chamber of the circuit-breaker and an interconnection casing for connecting it to a support column in a T-configuration of circuit-breakers.

In an advantageous embodiment of a circuit-breaker of the invention, the annular support constituting the primary comprises an annular portion which includes an outer collar, said collar being in axial alignment with and being fixed to a metal flange that is electrically connected to a contact of the circuit-breaker. Nevertheless, this implementation is not the only way the primary can be connected to the high voltage electrical potential of the phase: it is possible to envisage an electrical connection between the support and the contact without requiring a metal flange, and the link element used need not necessarily be circularly symmetrical. In another embodiment, the annular support comprises another annular portion which engages coaxially and in gastight manner in the annular first portion. Nevertheless, there exist circuit-breaker configurations of the invention in which it is not necessary for a support to be made as two annular portions, for example when the diameter of the circuit-breaker support column is small compared with the diameter of the interrupting chamber. The annular support constituting the primary can then be constituted as a single annular portion of L-shaped radial section around which the secondary is engaged prior to assembling the interrupting chamber on the support column.

In a column circuit-breaker configuration or in a T-configuration of circuit-breakers, the measurement signals recovered by the opto-electronic circuit can be conveyed to the ground by optical fibers, the optical fibers advantageously being guided along the outside of the support column without using gastight feedthroughs. In particular, if the support column is constituted by a tube made of a composite material of the type comprising glass fibers embedded in resin and having an elastomer covering, the optical fibers are protected as from the time when the circuit-breaker mounted on the support column leaves the factory. When the circuit-breaker is in use, the optical fibers may also be guided to the ground inside an additional column insulator disposed parallel to the support column that supports the interrupting chamber of the circuit-breaker.

BRIEF DESCRIPTION OF THE DRAWINGS

Other characteristics and advantages of a circuit-breaker of the invention will appear on reading the following description of embodiments.

In the figures:

FIG. 3 is a diagrammatic axial section view of a third structure for a circuit-breaker of the invention;

FIG. 4 is a diagrammatic axial section view of a fourth structure for a circuit-breaker of the invention;

MORE DETAILED DESCRIPTION

Figure 1:
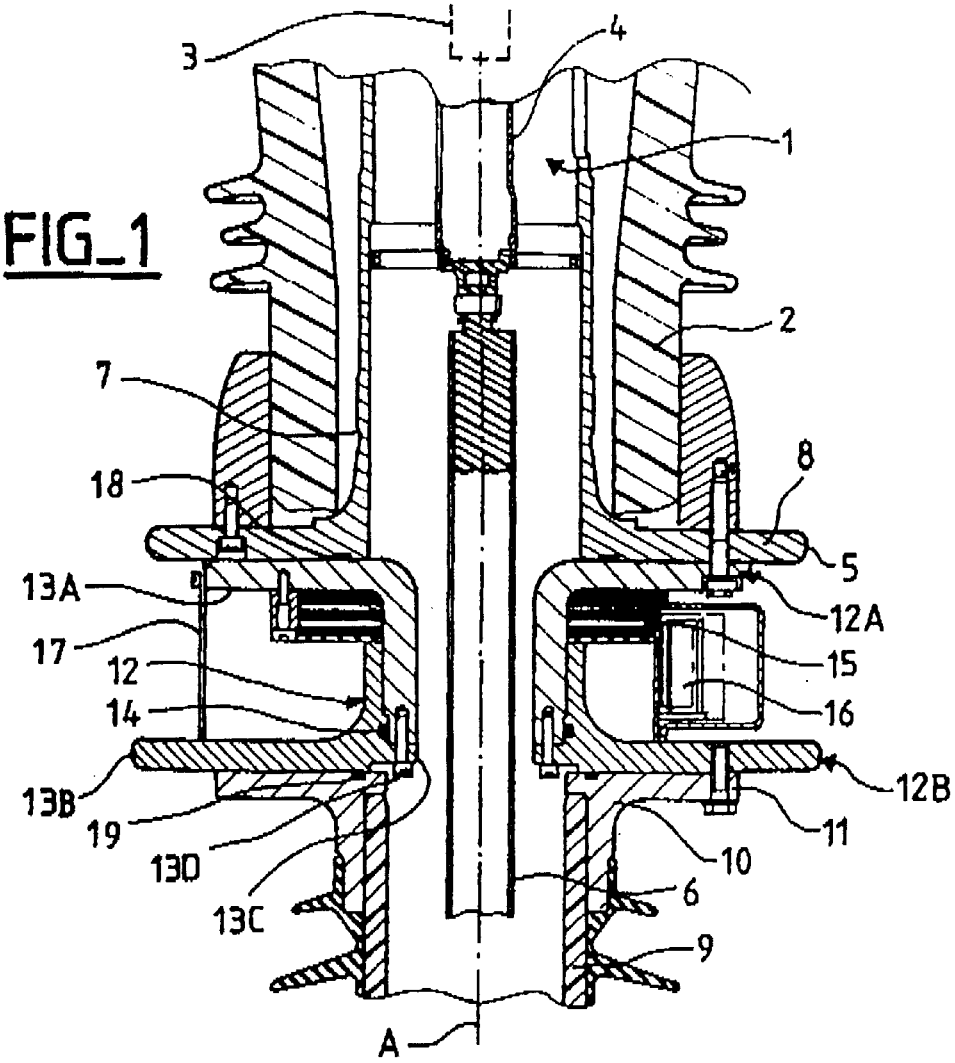
FIG. 1 is a diagrammatic axial section view of a first structure for a circuit-breaker of the invention.

The circuit-breaker, only a small part of which is shown in FIG. 1, is a column circuit-breaker that includes an interrupting chamber 1 formed by a tube 2 which is made of an electrically insulating material, e.g. a ceramic or a composite glass fiber and resin material, which, in this example, extends vertically along an axis A, and in which a first contact 3 and a second contact 4 are disposed. The tube 2 is filled with an insulation gas having high dielectric power, such as $SF_6$, under a pressure of a few bars. The contact 3 is electrically connected to a first terminal (not shown) provided at the top end of the tube 2. The contact 4 is mounted in the tube 2 to move relative to the contact 3 along the axis A, and it is connected mechanically to the contact 4 so as to move it along said axis, thereby opening or closing the circuit between the two terminals of the circuit-breaker. The contact 4 is connected electrically to a metal strength member or tubular flange-coupling piece 5 formed by a metal tube 7 inserted in the tube 2 and fixed thereto by clamping. The strength member 5 is provided with an annular plane collar 8 at the end of the tube 7, which collar extends radially towards the outside of the tube 2 from the axis A.

FIG. 1 shows an insulating column 9 on which the tube 2 forming the interrupting chamber 1 is mounted in alignment. The drive rod 6 passes through the support column 9 which extends vertically in this example, which is also filled with dielectric gas, and which is designed to be placed on a frame at ground potential. The support column 9 is also provided with a tubular flange-coupling piece 10 having an annular plane collar 11 analogous to the collar 8 of the flange-coupling piece 5 but whose outside diameter is slightly smaller.

A circuit-breaker of the invention includes an incorporated electronic current transformer which is organized to be suitable for being disposed at any one of the following locations: at the top of the interrupting chamber 1; at the interface between the interrupting chamber 1 and the support column 9; at the interface between the interrupting chamber 1 and a closure resistor casing disposed at the end of the interrupting chamber; on a closure resistor casing fixed to the end of the interrupting chamber 1; or at the interface between the interrupting chamber 1 and an interconnection casing for connecting the interrupting chamber to a support column in a T-shaped configuration of circuit-breakers.

In a circuit-breaker of the invention, the incorporated current transformer of the invention includes a primary circuit formed by an annular metal conductor 12 which simultaneously serves as a mechanical support when it lies at the interface between the interrupting chamber 1 and a support column such as 9, or a closure resistor casing or an interconnection casing as described above.

The annular metal conductor 12 is preferably made up of two annular portions 12A and 12B that engage or fit coaxially one in the other so that it is simple to put in place the secondary circuit of the transformer. More particularly, the portion 12A is formed by a first tube provided with an end outside annular collar 13A extending radially and having an outside diameter substantially identical to the outside diameter of the collar 11. The portion 12B is formed by a second tube that has an inside diameter slightly larger than the outside diameter of the first tube so as to fit onto the first tube of the portion 12A. The tube of the portion 12B is also provided with an end outside annular collar 13B extending radially and having an outside diameter substantially identical to the outside diameter of the collar 8. In addition, as shown in FIG. 1, the tube of the portion 12B is provided with an inside annular shoulder 13C to which the tube of the portion 12A is flanged-coupled, e.g. by screws 13D, when the two portions 12A and 13A are fitted one in the other. In this embodiment, the collars 13A and 13B are spaced apart from each other along the axis A and they define an annular space in which the secondary of the transformer is mounted. An O-ring gasket 14 is disposed between the two tubes of the portions 12A and 12B to seal the assembly.

Having the annular metal support 12 constructed as two portions 12A and 12B which interfit one within the other makes it possible to guarantee good mechanical strength regardless of whether the transformer is situated at the interface or at the end of the chamber, and also makes it possible to guarantee good gastightness relative to the insulation gas under a pressure of a few bars inside the interrupting chamber.

The secondary of the transformer is disposed around the primary 12 in air, and may be formed by Rogowski coils or by a Faraday crystal. As indicated above, each Rogowski coil such as 15 or the Faraday crystal (not shown) is inserted firstly onto the tube of one of the portions 12A or 12B by surrounding it with a small amount of clearance, and the tube of the other portion of the primary is mounted so that the secondary lies between the collars 13A and 13B of the primary. The opto-electronic circuit 16 of the transformer may advantageously be disposed in air in the vicinity of the secondary in the annular space between the collars 13A and 13B, and a removable protective casing 17 made of sheet metal may be fixed to the collar 13A or 13B so as to close the annular space to protect the secondary and the opto-electronic circuit from the outside environment. In the particular case of using a Faraday crystal as the secondary circuit, the circuit associated with the secondary can be made of purely optical means only that are connected by optical fibers to electronic means located on the ground, and the electronic portion of the overall optoelectronic circuit is then no longer subjected to the high voltage potential.

In the structure for the column circuit-breaker of FIG. 1, the electronic current transformer is disposed at the interface between the tube 2 of the interrupting chamber and the support column 9, and the drive rod 6 passes through it. More particularly, the collar 13A is fixed in alignment to the collar 8 and the collar 13B is fixed in alignment to the collar 11 by screws or the like. The interface between the tube 2 and the support column 9 is made gastight by means of an O-ring gasket 18 disposed between the collars 13A and 8, and by another O-ring gasket 19 disposed between the collars 13B and 11. In this construction, the collar 13B serves as a terminal for the circuit-breaker, and the tube and the column communicate with each other via the annular support 12 through which the insulation gas thus passes.

Figure 2:
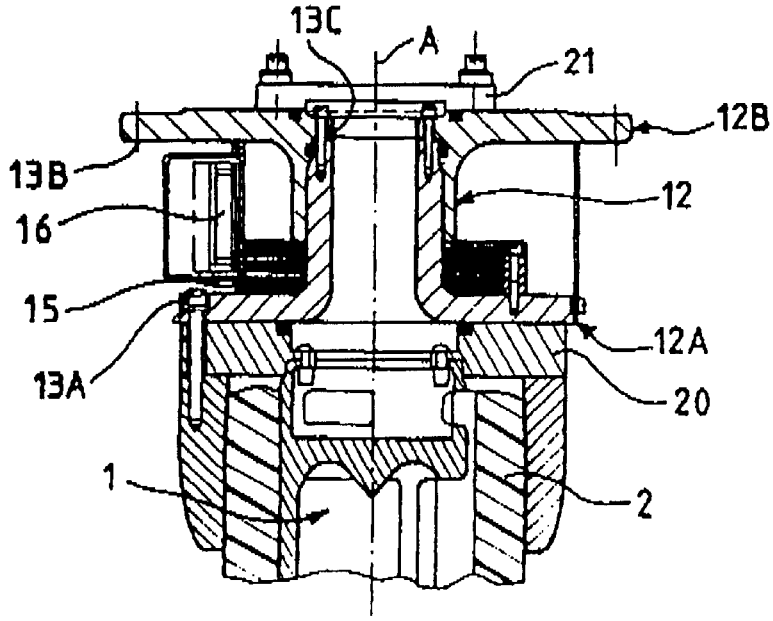
FIG. 2 is a diagrammatic axial section view of a second structure for a circuit-breaker of the invention.

FIG. 2 shows another structure for a circuit-breaker of the invention, in which the electronic current transformer is disposed at the free end of the interrupting chamber 1. More particularly, the tube 2 forming the interrupting chamber has its end provided with a metal annular flange 20 to which the collar 13A of the support 12 is fixed in alignment. The collar 13B serves as a terminal for the circuit-breaker, and has its inside annular space closed in gastight manner by a cover 21.

FIG. 3 shows another structure for a circuit-breaker of the invention, in which the electronic current transformer is disposed at the interface between the interrupting chamber 1 and metal casing 22 containing a closure resistor 23. This construction corresponds more particularly to two circuit-breakers being mounted in a T-configuration on a support column, the axis A of the tube 2 extending horizontally and perpendicularly to the support column. In FIG. 3, it can be seen that the metal annular flange 20 mounted at the end of the tube 2 is fixed in alignment to the collar 13A of the support 12, and the collar 13B of the support 12 is fixed in alignment to a metal annular flange 24 provided on the casing 22. The collar 13B also serves as a terminal for the circuit-breaker, and the casing 22 and the tube 2 communicate with each other via the annular support 12 through which the insulation gas passes. An electrical conductor 30 also passes through the support 12 interposed in gastight manner between the casing 22 and the tube 2, which conductor extends in the insulation gas between the closure resistor 23 in the casing 22 and a contact in the tube 2.

FIG. 4 shows another construction analogous to the construction shown in FIG. 3, but in which the transformer is placed on the closure resistor casing 22. In this example, the collar 13A of the support 12 is fixed in alignment to a metal annular flange 25 provided on the top of the casing 22, and the inside annular space of the portion 12B is closed by the cover 21. The collar 13B serves as a terminal for the circuit-breaker.

Figure 6:
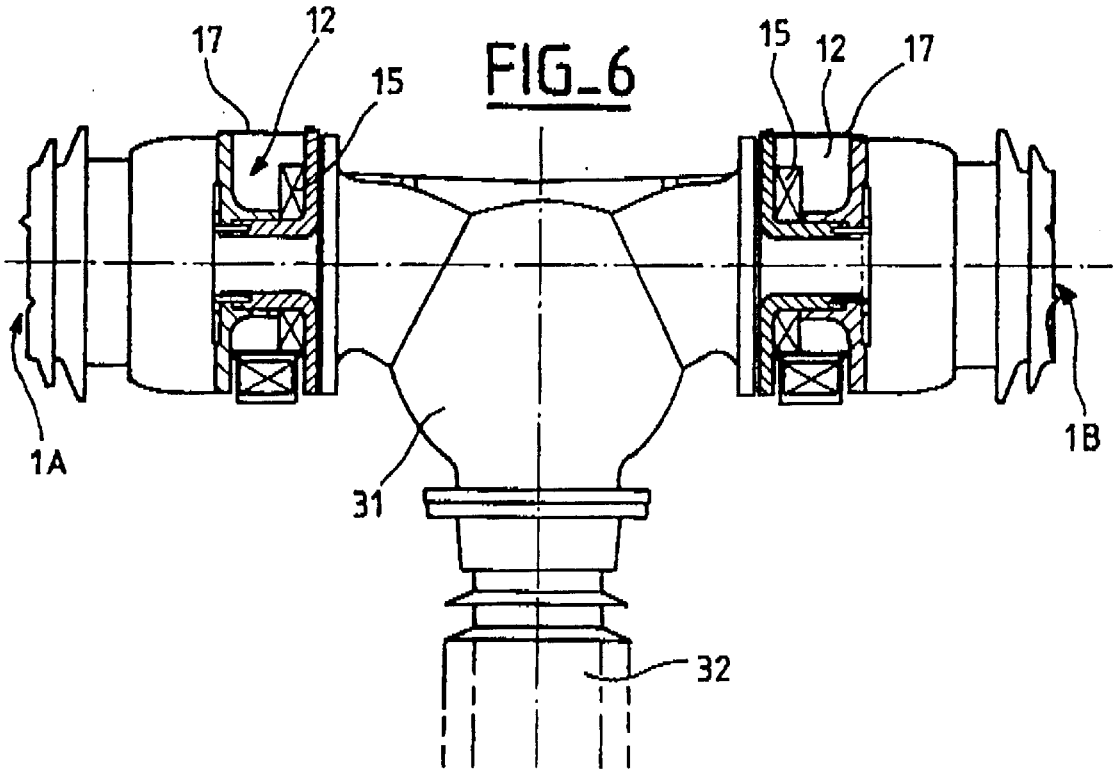
FIG. 6 is a diagrammatic plan view of a fifth structure for a circuit-breaker of the invention.

A transformer of the invention may also be disposed at the interface between an interrupting chamber and an interconnection casing for interconnecting two circuit-breakers mounted in a T-configuration on the top of a support column. In FIG. 6 and in a T-configuration of circuit-breakers, an interconnection casing 31 for interconnecting the interrupting chambers of the circuit-breakers overlies an insulating support column 32. The interrupting chambers 1A and 1B of two circuit-breakers extend perpendicular to the support column 32 on either side of the casing 31. Like the embodiments shown in the preceding figures, each current transformer comprises an annular support 12 forming the primary, a secondary 15 surrounding the primary 12, and a protective casing 17 enclosing the opto-electronic circuit with the secondary. The primaries of two current transformers are interposed in gastight manner both between the interrupting chamber 1A and the casing 31, and between the casing 31 and the interrupting chamber 1B.

Thus, the design of the electronic current transformer in a circuit-breaker of the invention makes the transformer modular and adaptable to suit numerous assembly configurations without jeopardizing its performance.

Figure 5:
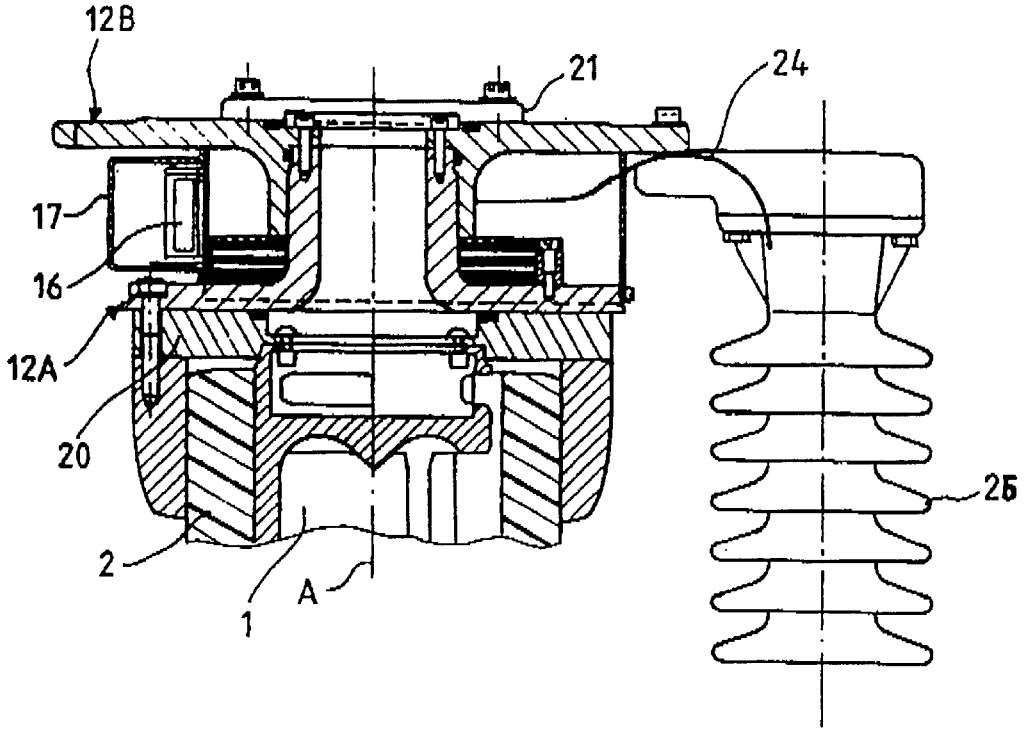
FIG. 5 is a diagrammatic axial section view of the FIG. 2 circuit-breaker with an insulator column for guiding the optical fibers to the ground.

In the circuit-breaker shown in FIGS. 1 and 2, the measurement signals recovered by the opto-electronic circuit 16 may be conveyed to the ground by optical fibers (not shown) guided outside the support column 9 and/or outside the tube forming the interrupting chamber. In FIG. 5, the optical fibers 24 are guided to the ground inside a column insulator 26 disposed parallel to the support column of the interrupting chamber 1 of the circuit-breaker.

What is claimed is:

1. A single-phase high voltage circuit-breaker comprising at least one interrupting chamber formed by an insulating tube filled with an insulation gas, and having, for at least one interrupting chamber, a current transformer which comprises a primary and a secondary, the secondary being disposed in the air around the primary at one end of said tube, the primary being at the high voltage electrical potential of the phase, wherein said primary is constituted by an annular metal support and wherein the secondary is subjected to a high voltage electrical potential that is practically equal to the potential of the primary.

2. The circuit-breaker of claim 1, in which said annular support comprises an annular portion which includes an outer collar, said collar being in axial alignment with and being fixed to a metal flange electrically connected to a contact of the circuit-breaker.

3. The circuit-breaker of claim 2, in which said annular support comprises another annular portion which engages coaxially in gastight manner in said annular portion.

4. The circuit-breaker of claim 3, in which each of the two annular portions includes a hollow cylindrical shank, said other annular portion being provided at one end with another outer collar capable of acting as a terminal.

5. The circuit-breaker of claim 4, in which said secondary is associated with an optoelectronic circuit and is located together therewith in the annular space situated between the two outer collars of said annular support, said annular space being closed by a removable casing.

6. The circuit-breaker of claim 1, in which said secondary is constituted by Rogowski coils or by a Faraday crystal.

7. The circuit-breaker of claim 1, in which the tube forming the interrupting chamber is mounted in alignment on a support column, the annular support being interposed in gastight manner between said tube and said support column, the tube and the column communicating through said annular support.

8. The circuit-breaker of claim 7, in which said annular support has an insulating drive rod passing therethrough which extends within the insulation gas between said tube and said support column and which can move a contact of the circuit-breaker.

9. The circuit-breaker of claim 1, comprising a closure resistor and in which said annular support is interposed in gastight manner between a casing for said closure resistor and the tube forming the interrupting chamber, the casing and the tube communicating via the annular support.

10. The circuit-breaker of claim 1, comprising a closure resistor disposed in a casing which communicates with the inside of the tube forming the interrupting chamber, in which said annular support is fixed to an annular metal flange which is fixed to said casing about the axis thereof.

11. The circuit-breaker of claim 1, in which the two interrupting chambers are connected in a T-configuration to a support column via a connection casing, and in which an annular support is interposed in gastight manner between each interrupting chamber and said connection casing.

* * * * *